US007973521B2

(12) United States Patent
Chen et al.

(10) Patent No.: US 7,973,521 B2
(45) Date of Patent: Jul. 5, 2011

(54) VOLTAGE REGULATORS

(75) Inventors: Hung-I Chen, Kaohsiung (TW); Chien Wei Kuan, Hsinchu (TW); Yen-Hsun Hsu, Hsinchu County (TW)

(73) Assignee: Mediatek Inc., Hsin-Chu (TW)

( * ) Notice: Subject to any disclaimer, the term of this patent is extended or adjusted under 35 U.S.C. 154(b) by 44 days.

(21) Appl. No.: 12/474,491

(22) Filed: May 29, 2009

(65) Prior Publication Data

US 2010/0033144 A1 Feb. 11, 2010

Related U.S. Application Data

(60) Provisional application No. 61/087,248, filed on Aug. 8, 2008.

(51) Int. Cl.
*G05F 1/00* (2006.01)

(52) U.S. Cl. ..... 323/273; 323/274

(58) Field of Classification Search ..... 323/273, 323/274, 349, 271, 224, 280, 282
See application file for complete search history.

(56) References Cited

U.S. PATENT DOCUMENTS

| | | | | |
|---|---|---|---|---|
| 6,414,537 | B1 | 7/2002 | Smith | |
| 7,397,227 | B2 * | 7/2008 | Ke et al. | 323/273 |
| 7,554,309 | B2 * | 6/2009 | Carpenter et al. | 323/282 |
| 7,652,455 | B2 * | 1/2010 | Demolli | 323/274 |

FOREIGN PATENT DOCUMENTS

CN 1609743 4/2005

OTHER PUBLICATIONS

English language translation of abstract of CN 1609743 (published Apr. 27, 2005).

* cited by examiner

*Primary Examiner* — Adolf Berhane
*Assistant Examiner* — Nguyen Tran
(74) *Attorney, Agent, or Firm* — Thomas | Kayden

(57) ABSTRACT

Voltage regulators are provided. In one embodiment of the voltage regulators, a differential amplifier receives a reference voltage and a feedback voltage, to generate a control signal according to a voltage difference between the feedback voltage and the reference voltage. An output transistor has a first terminal coupled to a power voltage, a control terminal coupled to the differential amplifier for receiving the control signal, and a second terminal coupled to an output terminal. A voltage feedback circuit is coupled between the output terminal and a ground voltage to generate the feedback voltage. A discharge transistor has a first terminal coupled to the ground voltage, a control terminal coupled to a first control signal, and a second terminal coupled to the output terminal through a first resistor in the voltage feedback circuit.

13 Claims, 4 Drawing Sheets

VOLTAGE REGULATORS

CROSS REFERENCE TO RELATED APPLICATIONS

This application claims the benefit of U.S. Provisional Application No. 61/087,248, filed Aug. 8, 2008, the entirety of which is incorporated by reference herein.

BACKGROUND OF THE INVENTION

1. Field of the Invention

The invention generally relates to voltage reference circuits and, more particularly, to voltage regulators capable of fast shutdown.

2. Description of the Related Art

Precision voltage reference circuits are critical elements of various devices, systems and equipment, such as portable devices, instrumentation and test equipment, data acquisition systems, medical equipment, servo systems, and the like. Voltage reference circuits are used to supply a steady and reliable voltage reference to other circuits or systems. Similarly, low drop-out voltage (LDO) regulators are also used to provide regulated voltages in a precise and reliable manner. Generally, in order to ensure that power supply is shutdown rapidly without negatively influencing the devices, systems or equipment, a fast shutdown device is required to perform a fast shutdown. However, for conventional LDO regulators, an electrostatic discharge (ESD) device with a large area is required to protect fast shutdown devices. In addition, the fast shutdown devices would become a bottleneck of ESD performance.

BRIEF SUMMARY OF THE INVENTION

An embodiment of a voltage regulator is provided, in which a differential amplifier receives a reference voltage and a feedback voltage, to generate a control signal according to a voltage difference between the feedback voltage and the reference voltage. An output transistor has a first terminal coupled to a power voltage, a control terminal coupled to the differential amplifier for receiving the control signal, and a second terminal coupled to an output terminal. A voltage feedback circuit is coupled between the output terminal and a ground voltage to generate the feedback voltage. A discharge transistor has a first terminal coupled to the ground voltage, a control terminal coupled to a first control signal, and a second terminal coupled to the output terminal through a first resistor in the voltage feedback circuit.

The invention also provides an embodiment of the voltage regulator, in which a differential amplifier receives a reference voltage and a feedback voltage, to generate a control signal according to a voltage difference between the feedback voltage and the reference voltage. An output transistor has a first terminal coupled to a power voltage, a control terminal coupled to the differential amplifier for receiving the control signal, and a second terminal coupled to an output terminal. A first resistor is coupled between the output terminal and a ground voltage, and a second resistor is coupled between the output terminal and the differential amplifier. A discharge transistor has a first terminal coupled to the output terminal through the second resistor, a control terminal coupled to a first control signal, and a second terminal coupled to the ground voltage.

The invention also provides another embodiment of the voltage regulator, in which a differential amplifier receives a reference voltage and a feedback voltage, to generate a control signal according to a voltage difference between the feedback voltage and the reference voltage. An output transistor has a first terminal coupled to a power voltage, a control terminal coupled to the differential amplifier for receiving the control signal, and a second terminal coupled to an output terminal. A first resistor is provided, and a discharge transistor has a first terminal coupled to the ground voltage, a control terminal coupled to a first control signal, and a second terminal coupled to the output terminal through the first resistor.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
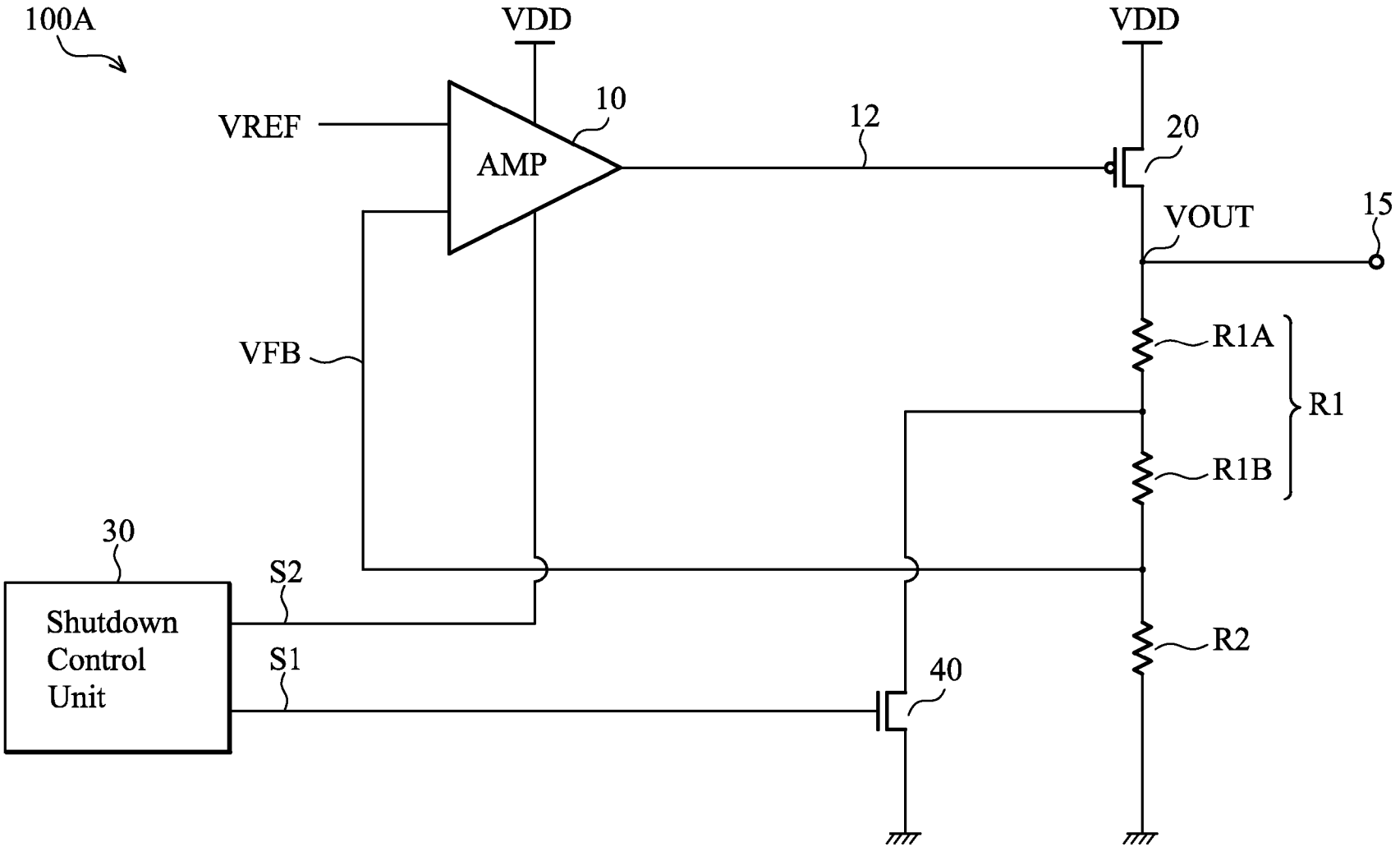
FIG. 1 shows an embodiment of a voltage regulator according to the invention.

FIG. 1 shows an embodiment of a voltage regulator according to the invention. As shown, a voltage regulator 100A comprises a differential amplifier 10, an output transistor 20, a shutdown control unit 30, a discharge transistor 40, and a voltage feedback circuit (i.e., R1 and R2). The voltage regulator 100A is used to provide a steady and reliable output voltage VOUT to other circuits or systems (not shown) through an output terminal 15 thereof. The differential amplifier 10 comprises a first input terminal for receiving a reference voltage VREF, a second input terminal for receiving a feedback voltage VFB and an output terminal coupled to the control terminal of the output transistor 20. The differential amplifier 10 generates a control signal 12 to control the output transistor 20 according to a voltage difference between the reference voltage VREF and the feedback voltage VFB.

The output transistor 20 comprises a first terminal coupled to a power voltage VDD, a control terminal coupled to the control signal from the differential amplifier 10 and a second terminal coupled to the output terminal 15. The shutdown control unit 30 generates control signals S1 and S2 to control turning on/off of the discharge transistor 40 and the differential amplifier 10. The discharge transistor 40 selectively pulls the output terminal 15 to the ground voltage according to the control signal S1 from the shutdown control unit 30. Resistors R1 and R2 are connected in series to form the voltage feedback circuit thereby performing voltage division on the output voltage VOUT to generate the feedback voltage VFB. In this embodiment, the voltage at the node between the resistor R1 and R2 serves as the feedback voltage VFB, and the resistor R1 comprises series-connected resistors R1A and R1B. It should be noted that the resistance of the resistor R1A is about 200Ω, and the resistances of the resistors R1B and R2 can be several hundred times that of the resistor R1A, but is not limited thereto.

During a shutdown mode, the shutdown control unit 30 outputs the control signal S2 to turn off the differential amplifier 10, such that the output transistor 20 is turned off accordingly. In addition, the shutdown control unit 30 outputs the control signal S1 to turn on the discharge transistor 40 thereby pulling the output terminal 15 to the ground voltage, such that negative influences for devices, systems or equipment caused by the voltage at the output terminal 15 can be prevented. During a normal operation mode, the discharge transistor 40 is turned off and does not affect the normal operation of other elements. In this embodiment, because the discharge transistor 40 is coupled to the output terminal 15 through the resistor R1A, the resistor R1A can serve as an ESD protection resistor for the discharge transistor 40. As such, the area normally consumed by the ESD protection device coupled between the output terminal 15 and the ground terminal can be eliminated while maintaining appropriate ESD performance and achieving fast shutdown.

Figure 2:
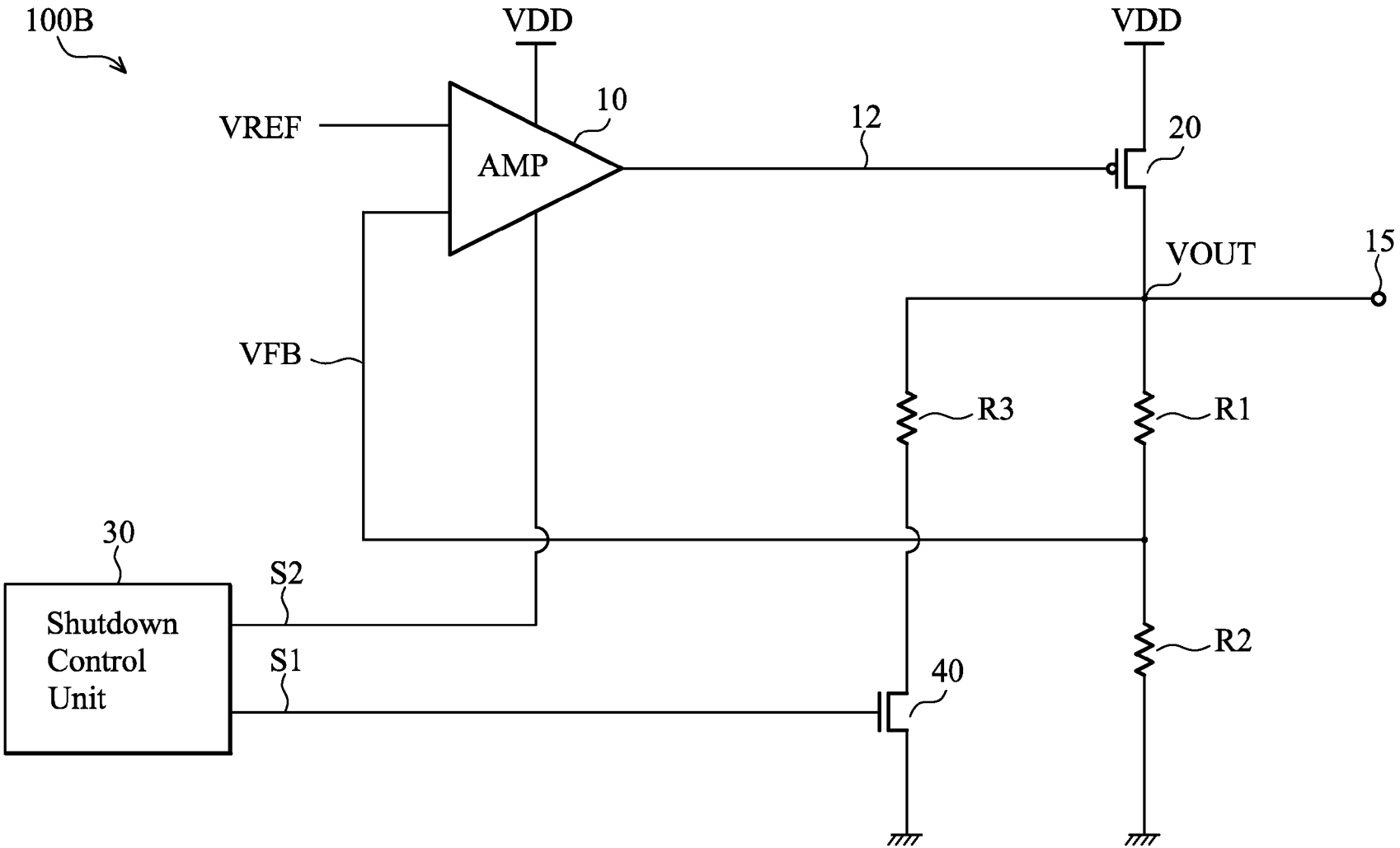
FIG. 2 shows another embodiment of the voltage regulator according to the invention.

FIG. 2 shows anther embodiment of a voltage regulator according to the invention. As shown, the voltage regulator 100B is similar to the voltage regulator 100A shown in FIG. 1, wherein the difference is that the discharge transistor 40 is coupled to the output terminal 15 through a resistor R3 rather than the resistor R1A of FIG. 1 in the voltage feedback circuit composed by the resistors R1 and R2. Operations of the voltage regulator 100B that are similar to those of the voltage regulator 100A, are omitted for brevity. It should be noted that the resistance of the resistor R3 is much smaller than those of the resistors R1 and R2. For example, the resistance of the resistor R3 is about 200Ω, and the resistances of the resistors R1 and R2 can be several hundred times that of the resistor R3, but is not limited thereto. In this embodiment, the resistor R3 can serve as an ESD protection resistor for the discharge transistor 40. As such, the area normally consumed by the ESD protection device coupled between the output terminal 15 and the ground terminal can be eliminated while maintaining good ESD performance and achieving fast shutdown.

Figure 3:
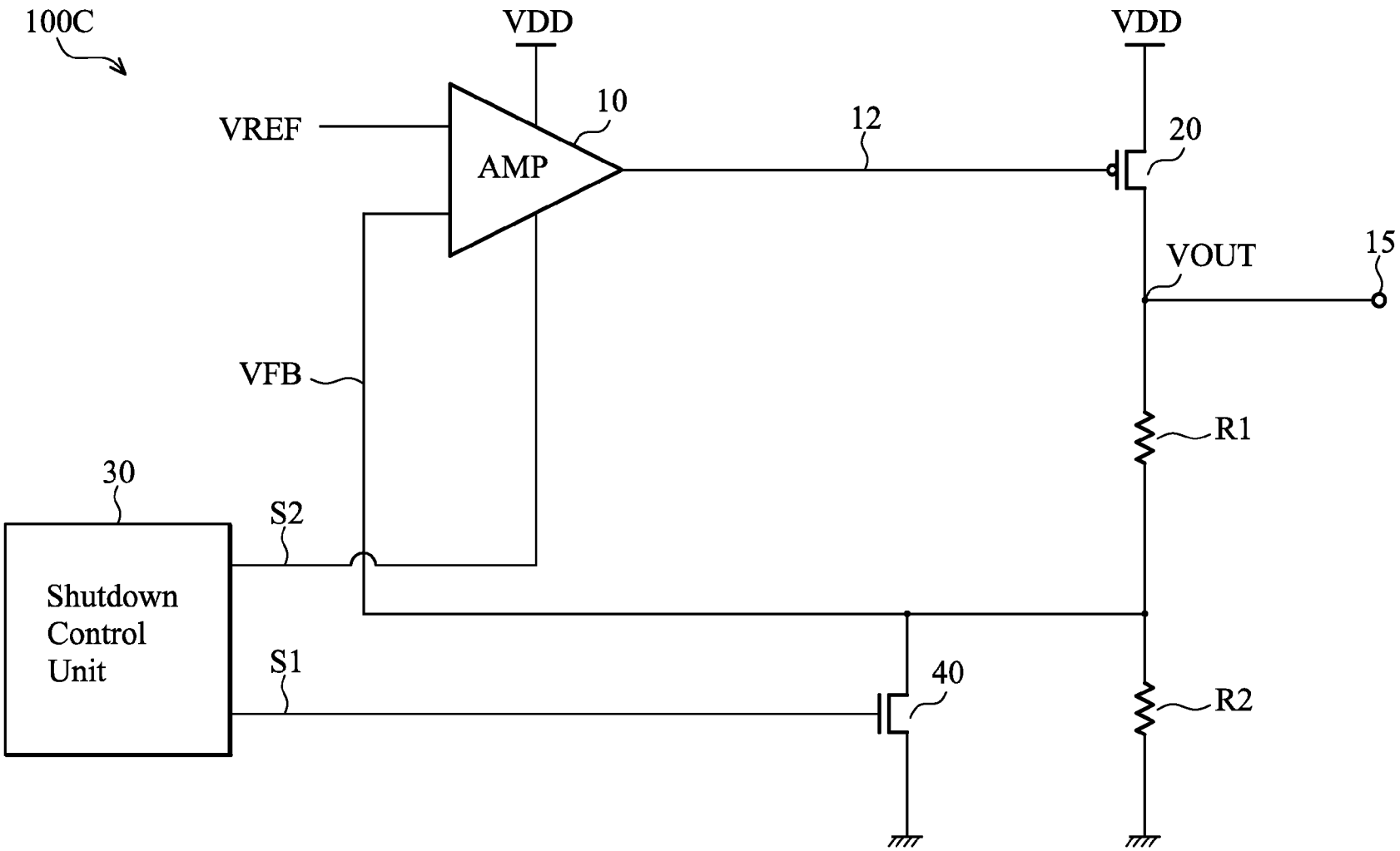
FIG. 3 shows another embodiment of the voltage regulator according to the invention.

FIG. 3 shows anther embodiment of a voltage regulator according to the invention. As shown, the voltage regulator 100C is similar to the voltage regulator 100A shown in FIG. 1, wherein the difference is that the discharge transistor 40 is coupled to the output terminal 15 through the resistor R1 in the voltage feedback circuit and resistance of the resistor R1 is much smaller than that of the resistor R2. Operations of the voltage regulator 100C that are similar to those of the voltage regulator 100A, are omitted for brevity. During operation of the voltage regulator 100C, the resistance of the resistor R1 is about 200Ω, and the resistance of the resistor R2 can be several hundred times that of the resistor R1. Because resistance of the resistor R1 is much smaller than that of the resistor R2, the voltage regulator 100C serves as a unit gain voltage regulator. In addition, the resistor R1 can serve as an ESD protection resistor for the discharge transistor 40. As such, the area normally consumed by the ESD protection device coupled between the output terminal 15 and the ground terminal can be eliminated while maintaining good ESD performance and achieving fast shutdown.

Figure 4:
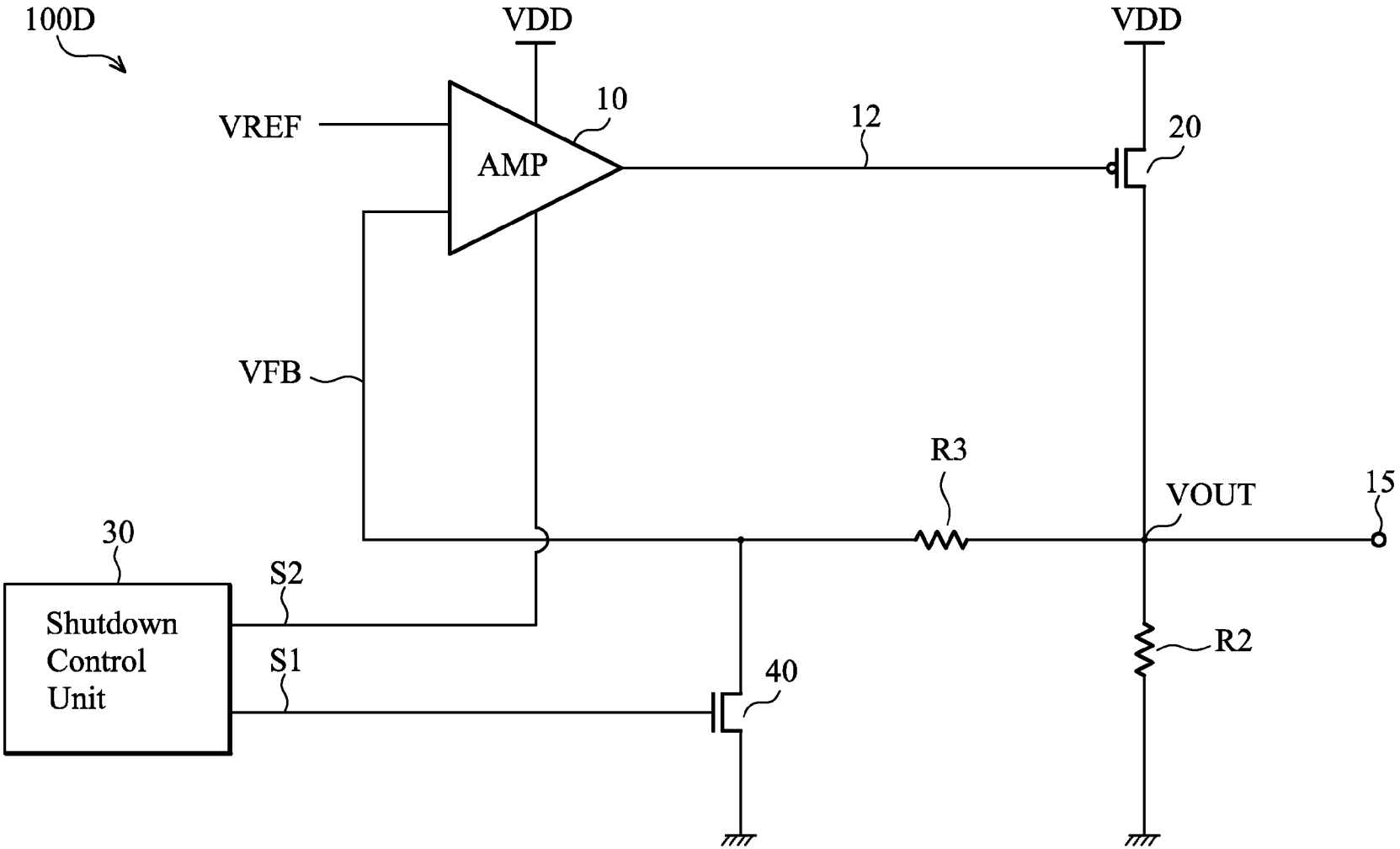
FIG. 4 shows another embodiment of the voltage regulator according to the invention.

FIG. 4 shows another embodiment of a voltage regulator according to the invention. As shown, the voltage regulator 100D is similar to the voltage regulator 100A shown in FIG. 1, wherein the difference is that the discharge transistor 40 is coupled to the output terminal 15 through the resistor R3 coupled between one input terminal of the differential amplifier 10 and the output terminal 15 rather than the resistor R1A in the voltage feedback circuit composed of the resistors R1 and R2. Operations of the voltage regulator 100D that are similar to those of the voltage regulator 100A, are omitted for brevity. During operation of the voltage regulator 100D, the resistance of the resistor R3 is about 200Ω, and the resistance of the resistor R2 can be several hundred times that of the resistor R3, but is not limited thereto. Because resistance of the resistor R3 is much smaller than that of the resistor R2, the voltage regulator 100D serves as a unit gain voltage regulator. In addition, the resistor R3 can serve as an ESD protection resistor for the discharge transistor 40. As such, the area normally consumed by ESD protection device coupled between the output terminal 15 and the ground terminal can be eliminated while maintaining good ESD performance and achieving fast shutdown.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A voltage regulator, comprising:

a differential amplifier receiving a reference voltage and a feedback voltage, generating a control signal according to a voltage difference between the feedback voltage and the reference voltage;

an output transistor having a first terminal coupled to a power voltage, a control terminal coupled to the differential amplifier for receiving the control signal, and a second terminal coupled to an output terminal;

a voltage feedback circuit coupled between the output terminal and a ground voltage, generating the feedback voltage; and a discharge transistor having a first terminal coupled to the ground voltage, a control terminal coupled to a first control signal, and a second terminal coupled to the output terminal through a first resistor in the voltage feedback circuit; wherein the voltage feedback circuit comprises:

a second resistor and the first resistor connected in series between the output terminal and a first node, the first resistor is served as an ESD protection resistor for the discharge transistor; and a third resistor coupled between the first node and the ground voltage, wherein a voltage level at the first node serves as the feedback voltage.

2. The voltage regulator of claim 1, wherein the voltage regulator is a low drop-out voltage (LDO) regulator.

3. The voltage regulator of claim 1, wherein the output transistor is a PMOS transistor, and the discharge transistor is an NMOS transistor.

4. The voltage regulator of claim 1, wherein, during a shutdown mode, the discharge transistor is turned on to pull the output terminal to the ground voltage according to the first control signal.

5. The voltage regulator of claim 4, wherein, during the shutdown mode, the differential amplifier is turned off according to a second control signal such that the output transistor is turned off.

6. A voltage regulator, comprising:

a differential amplifier receiving a reference voltage and a feedback voltage, generating a control signal according to a voltage difference between the feedback voltage and the reference voltage;

an output transistor having a first terminal coupled to a power voltage, a control terminal coupled to the differential amplifier for receiving the control signal, and a second terminal coupled to an output terminal;

a first resistor coupled between the output terminal and a ground voltage;

a second resistor coupled between the output terminal and the differential amplifier;

a third resistor having a first terminal coupled to the output terminal; and a discharge transistor coupled between a second terminal of the third resistor and the ground voltage, and pulling the output terminal to the ground voltage according to a first control signal during a shutdown mode.

7. The voltage regulator of claim 6, wherein the differential amplifier is turned off during the shutdown mode such that the output transistor is turned off accordingly.

8. The voltage regulator of claim 6, wherein the voltage regulator is a low drop-out voltage (LDO) regulator.

9. The voltage regulator of claim 6, wherein the output transistor is a PMOS transistor, and the discharge transistor is an NMOS transistor.

10. A voltage regulator, comprising:

a differential amplifier receiving a reference voltage and a feedback voltage, generating a control signal according to a voltage difference between the feedback voltage and the reference voltage;

an output transistor having a first terminal coupled to a power voltage, a control terminal coupled to the differential amplifier for receiving the control signal, and a second terminal coupled to an output terminal;

a first resistor;

a discharge transistor having a first terminal coupled to the ground voltage, a control terminal coupled to a first control signal, and a second terminal coupled to the output terminal through the first resistor, wherein the first resistor has a first terminal coupled to the output terminal and a second terminal coupled to the differential amplifier, the second terminal of the discharge transistor is coupled to the second terminal of the first resistor; and a second resistor comprising a first terminal directly connected to the output terminal and a second terminal coupled to the ground voltage.

11. The voltage regulator of claim 10, wherein, during a shutdown mode, the discharge transistor pulls the output terminal to the ground voltage according to the first control signal and the differential amplifier is turned off such that the output transistor is turned off accordingly.

12. The voltage regulator of claim 10, wherein the voltage regulator is a low drop-out voltage (LDO) regulator.

13. The voltage regulator of claim 10, wherein the output transistor is a PMOS transistor, and the discharge transistor is an NMOS transistor.

* * * * *